US005365966A

United States Patent [19]

McLaren

[11] Patent Number: 5,365,966

[45] Date of Patent: Nov. 22, 1994

[54] CARRY FREE UMBRELLA

[76] Inventor: Errol McLaren, Rt. 1 Box 312, W. Hurley, N.Y. 12491

[21] Appl. No.: 871,000

[22] Filed: Jun. 11, 1992

[51] Int. Cl.[5] ..... A45B 25/00

[52] U.S. Cl. ..... 135/16; 135/24; 135/25.4; 135/25.41

[58] Field of Search ..... 135/16, 31, 24, 25.4, 135/25.41

[56] References Cited

U.S. PATENT DOCUMENTS

| | | | |
|---|---|---|---|
| 2,434,526 | 1/1948 | Thornton | 135/16 |
| 4,188,965 | 2/1980 | Morman | 135/16 |
| 4,624,276 | 11/1986 | Allen | 135/25.4 |
| 4,760,610 | 8/1988 | Wu et al. | 135/16 |
| 4,823,821 | 4/1989 | Day | 135/24 |
| 4,930,533 | 6/1990 | Allen | 135/25.4 |

*Primary Examiner*—Carl D. Friedman
*Assistant Examiner*—Wynn Wood
*Attorney, Agent, or Firm*—Jospeh B. Taphorn

[57] ABSTRACT

An umbrella is provided for carrying on a person's arm to leave both hands free for other purposes. A hollow handle is provided on the lower end of the umbrella to store an extendable band in a retracted condition to which it is spring biased. The band is manually extended to allow a person's arm to be placed through the loop so formed, and band's spring bias holds the handle and hence the umbrella tight on the arm.

16 Claims, 2 Drawing Sheets

CARRY FREE UMBRELLA

INTRODUCTION

1. Field of the Invention

This invention relates to umbrellas, and more particularly, to an umbrella that need not be carried by hand when in use.

2. Background of the Invention

The umbrella has been around as long as man can remember and has always been used in only one way—carried by hand. Over the years it has been found that while carrying the umbrella by hand might do the job of fending-off the elements, it can sometimes be very difficult and awkward if the hands are needed for other purposes while carrying the umbrella.

PRIOR ART

Umbrellas are formed with either a straight or a curved handle. In either case they are grasped by a hand, leaving only one hand free to do other things.

SUMMARY OF THE INVENTION

Accordingly, it is the object of the invention to make more efficient use of the umbrella.

The object of the invention is achieved by wearing the umbrella on the arm, thereby freeing up the hands for other purposes.

BRIEF DESCRIPTION OF THE DRAWINGS

These and other objects, features, and advantages of the invention will become apparent from a reading of the following description, when considered with the attached drawings wherein.

DETAILED DESCRIPTION OF THE PREFERRED EMBODIMENT

Figure 1:
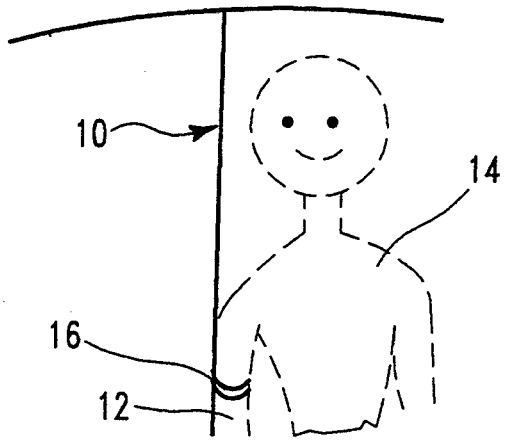
FIG. 1 is a schematic view of the umbrella according to the invention mounted on the arm of a person to free up both of that person's hands for other purposes.

Referring now more particularly to the drawings, there is shown in FIG. 1 schematic umbrella generally indicated by the numeral 10. The umbrella 10 is attached to the arm 12 of a person 14 by a band 16.

Figure 2:
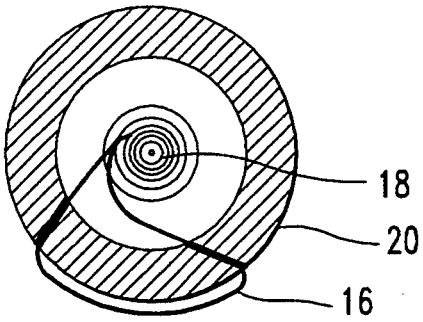
FIG. 2 is a diagrammatical cross-sectional view of the handle of the umbrella showing the band for mounting the umbrella on a person's arm in retracted condition.
Figure 3:
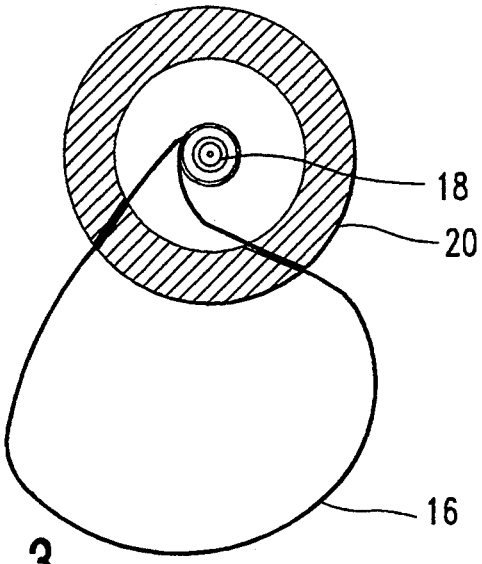
FIG. 3 is a similar diagrammatical cross-sectional view showing the band in an extended condition for mounting the umbrella on a person's arm.
Figure 4:
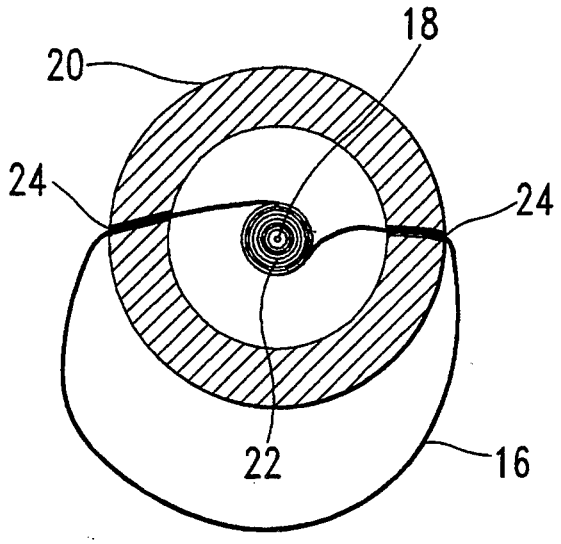
FIG. 4 is a similar diagrammatical cross-sectional view showing the concentric spring for rotating the shaft on which the band is wrapped when in retracted position.

As best seen in FIGS. 2–4, both ends of the band 16 are wrapped in overlapping relationship on a shaft 18 rotatably mounted in the center of a hollow handle 20 for the umbrella 10. A concentric spring 22 (FIG. 4) surrounds the shaft 18 and is biased to drive the it in a direction to wrap the band 16 on to it so that the nad may be snug against the handle 20 when it is not being used as an arm mount for the umbrella (FIG. 2).

The band 16 extends outside of the handle 20 through vertical slots 24 formed in opposite sides of the handle at the level that the band is wrapped on the shaft 18.

The band 16 may be pulled outwards against the tension of the concentric spring 22 through the slots 24 to an extended condition enabling a person's arm to be put therethrough: upon release of the band 16, the concentric spring 22 will retract it until it is snug on the wearer's arm 12; upon removal of the arm and its release, the spring 22 will retract it all the way in until the portion remaining outside rests against the outside of the handle 20.

Figure 5:
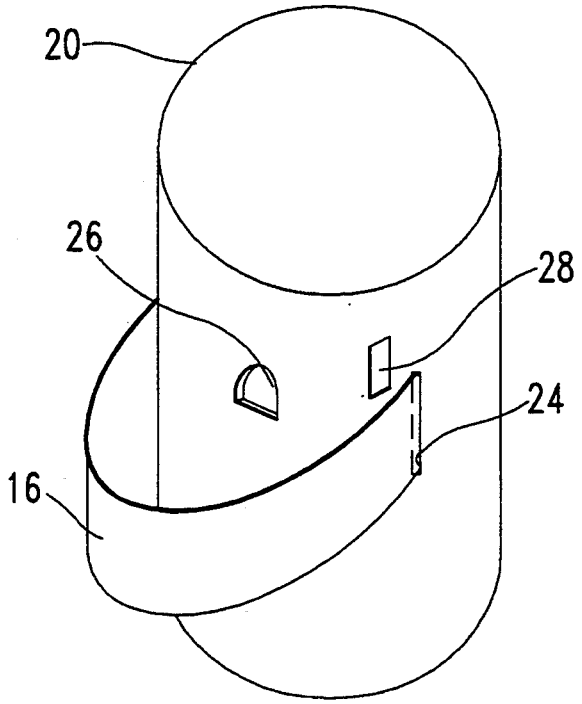
FIG. 5 is a enlarged diagrammatic isometric view showing the exterior of the handle and band in greater detail.

As best seen in FIG. 5, the surface of the handle 20 may be formed with an indentation 26 to permit the extraction of the band 16 in order to extend it. A small clip 28 may be employed to hold the band 16 in extended condition to facilitate insertion of the arm 12, and to allow the spring bias to take over after arm insertion and allow its contraction to hold the umbrella in place.

Thus it can be appreciated that inside the handle 20 of the umbrella 10 there will be a strap or band 16 under tension that can be adjusted to fit the arm 12 of the wearer 14. This band which will protrude from the arm of handle or arm 20 of umbrella 10 will be kept under tension by a spring 22 inside the handle or arm, and will be retractable enough to fit against the arm or handle so that the umbrella can be carried or closed in a normal fashion.

Wearing the umbrella 10 on the arm 12 can be achieved by opening it and slipping the arm into the band.

One attractiveness of the invention is a "choice" in the use of the umbrella. It can be worn on the arm 12 of the person when his hands are occupied, and it can be carried in normal fashion when the hands are free. It will solve the common problem of people struggling to carry an umbrella when the hands are already occupied.

It will be appreciated that while there has been shown a preferred embodiment of the invention, other advantages applications of the principles of the invention will be apparent to those skilled in the art. Accordingly, it is intended to be limited only by the scope or spirit of the appended claims.

What is claimed is:

1. An umbrella for carrying on an arm, comprising a collapsable canopy, a central rod mounting said canopy, a handle on the lower end of said rod for holding the umbrella, and a mechanism including a broad band on said handle for mounting the handle upright on a person's arm, said handle having a top, a bottom, and a side, said handle including two slots located in said side, said broad band emanating from said two slots.

2. An umbrella according to claim 1, wherein the band is biased to an arm tightened position.

3. An umbrella according to claim 1, wherein the handle is hollow and the band is stored therein when not in use.

4. An umbrella according to claim 3, wherein the band has two ends and is stored by wrapping it on a shaft in the handle.

5. An umbrella according to claim 4, wherein the shaft is rotable, and a spring concentric with the shaft biases the shaft to a position in which the band is stored.

6. An umbrella according to claim 4, wherein the band is double-wrapped on the shaft.

7. An umbrella according to claim 5, and a releasable clip on the handle holds the band in an extended position against the bias of the spring to facilitate arm insertion in the loop so formed.

8. An umbrella according to claim 5, wherein the band is stored in the handle by double-wrapping it on said rotable shaft, said two slots in the handle respectfully permit the passage of the two ends of the band in and out of the handle, and a concentric spring biasing the shaft to a position in which the band is retracted to a double-wrapped condition within the hollow handle save for a portion extending about the handle between the two slots.

9. An umbrella for carrying on an arm, comprising a light portable canopy, a handle, a folding frame for mounting said canopy, and a mechanism including a broad band associated with said folding frame for supporting the umbrella upright solely by a person's arm, said handle having a top, a bottom, and a side, said handle including two slots located in said side, said broad band emanating from said two slots.

10. An umbrella according to claim 9, wherein the mechanism still allows carrying the umbrella in normal fashion by a hand.

11. An umbrella for carrying on an arm, comprising a handle having a top, a bottom, and a side, said handle including two slots located in said side, said umbrella further comprising a broad band emanating from said two slots on the side of said handle for encircling an arm, and means for tightening the band on the arm.

12. An umbrella according to claim 11, wherein the handle is hollow and the band is stored within the handle.

13. An umbrella according to claim 12, wherein the handle has a rotatable shaft on which the band is wrapped, the band having two ends.

14. An umbrella according to claim 13, where the handle also has a concentric spring biasing the shaft to a position in which the band is retracted into the handle.

15. An umbrella according to claim 14, wherein said two slots permit passage of said two ends of the band in and out of the handle wherein the band is double-wrapped on said rotatable shaft.

16. An umbrella according to claim 1, wherein the mechanism still allows carrying the umbrella in normal fashion by a hand.

* * * * *